US008407837B1

(12) United States Patent
Huang et al.

(10) Patent No.: US 8,407,837 B1
(45) Date of Patent: Apr. 2, 2013

(54) FOLDABLE STRUCTURE FOR A HOSPITAL BED

(71) Applicants: Yu-Chieh Huang, Chiayi (TW); Chung-Yung Huang, Chiayi (TW); Chung-Yi Huang, Chiayi (TW)

(72) Inventors: Yu-Chieh Huang, Chiayi (TW); Chung-Yung Huang, Chiayi (TW); Chung-Yi Huang, Chiayi (TW)

(73) Assignee: Nan Yi Shyh Co., Ltd., Chiayi (TW)

( * ) Notice: Subject to any disclaimer, the term of this patent is extended or adjusted under 35 U.S.C. 154(b) by 0 days.

(21) Appl. No.: 13/633,170

(22) Filed: Oct. 2, 2012

(51) Int. Cl.
*A61G 7/002* (2006.01)

(52) U.S. Cl. ..... 5/620; 5/288; 5/285; 5/116

(58) Field of Classification Search ..... 5/110–114, 5/116, 135, 174, 285, 620, 245–250, 53.1, 5/288
See application file for complete search history.

(56) References Cited

U.S. PATENT DOCUMENTS 2,357,242 A * 8/1944 Wahl ..... 5/618
4,157,089 A * 6/1979 Loughrey ..... 606/245
4,970,737 A * 11/1990 Sagel ..... 5/620
6,076,210 A * 6/2000 Wu ..... 5/618

* cited by examiner

*Primary Examiner* — Fredrick Conley
(74) *Attorney, Agent, or Firm* — Alan Kamrath; Kamrath IP Lawfirm, P.A.

(57) ABSTRACT

A foldable structure for a hospital bed contains two mounts, a bed frame, and a bed plane, each mount including two rotary positioning pieces, wherein each rotary positioning piece has a hole and an arcuate groove to axially connect the each rotary positioning piece with two coupling elements of the bed frame, such that the bed frame rotates relative to the two mounts, the each rotary positioning piece has two orifices corresponding to two ends of the arcuate groove so that a spring pin of each side of the bed frame is inserted into one of the two orifices of the each rotary positioning pieces, hence the spring pin is pushed out of the one of the two orifices of the each rotary positioning pieces, a coupling element in the arcuate groove rotates smoothly relative to a coupling element in the hole, thus retracting or expanding the bed frame easily.

2 Claims, 5 Drawing Sheets

FOLDABLE STRUCTURE FOR A HOSPITAL BED

BACKGROUND OF THE INVENTION

1. Field of the Invention

The present invention relates to a foldable structure for a hospital bed, and more particularly to a foldable structure for a hospital bed which is retracted and expanded easily.

2. Description of the Prior Art

A conventional hospital bed is used by a patient and is designed in a multi-section manner so as to be operated at various angles by ways of a hydraulic cylinder, but such a structure is complicated and assembled difficultly.

A conventional hospital bed structure includes two mounts disposed on a front end and a rear end thereof, a bed frame, and a bed plane arranged on the bed frame. When shipping the hospital bed, the two mounts are not assembled so that the two mounts are folded on the bed frame, and the bed plane is stored in a flat shape, thus shipping the hospital bed structure conveniently. However the hospital bed structure is assembled by using a tool, thus assembling the hospital bed structure inconveniently. Also, because the conventional hospital bed structure occupies space, it is stored while not being used. However, the conventional hospital bed structure is assembled at much labor and time consumption while in use again.

The present invention has arisen to mitigate and/or obviate the afore-described disadvantages.

SUMMARY OF THE INVENTION

The primary object of the present invention is to provide a foldable structure for a hospital bed which allows expanding a plurality of rods securely and supporting two mounts stably.

Further object of the present invention is to provide a foldable structure for a hospital bed in which a hospital bed matches with each mount and a bed frame so as to be stored in a flat shape and in a small size easily.

Another object of the present invention is to provide a foldable structure for a hospital bed in which a bed frame and the two mounts are expanded quickly without using any tool and storing the hospital bed easily.

A foldable structure for a hospital bed in accordance with a preferred embodiment of the present invention contains:

two mounts, a bed frame, and a bed plane arranged on the bed frame, each mount including two rotary positioning pieces fixed on two sides thereof and axially connecting with the bed frame, wherein each rotary positioning piece has a hole and an arcuate groove defined under the hole so as to axially connect the each rotary positioning piece with two coupling elements of the bed frame, such that the bed frame rotates relative to the two mounts, and the each rotary positioning piece also has two orifices corresponding to two ends of the arcuate groove so that a spring pin of each side of the bed frame is inserted into one of the two orifices of the each rotary positioning pieces, hence the spring pin is pushed out of the one of the two orifices of the each rotary positioning pieces, and a coupling element in the arcuate groove rotates smoothly relative to a coupling element in the hole so that the bed frame is retracted or expanded rotatably relative to the each mount.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
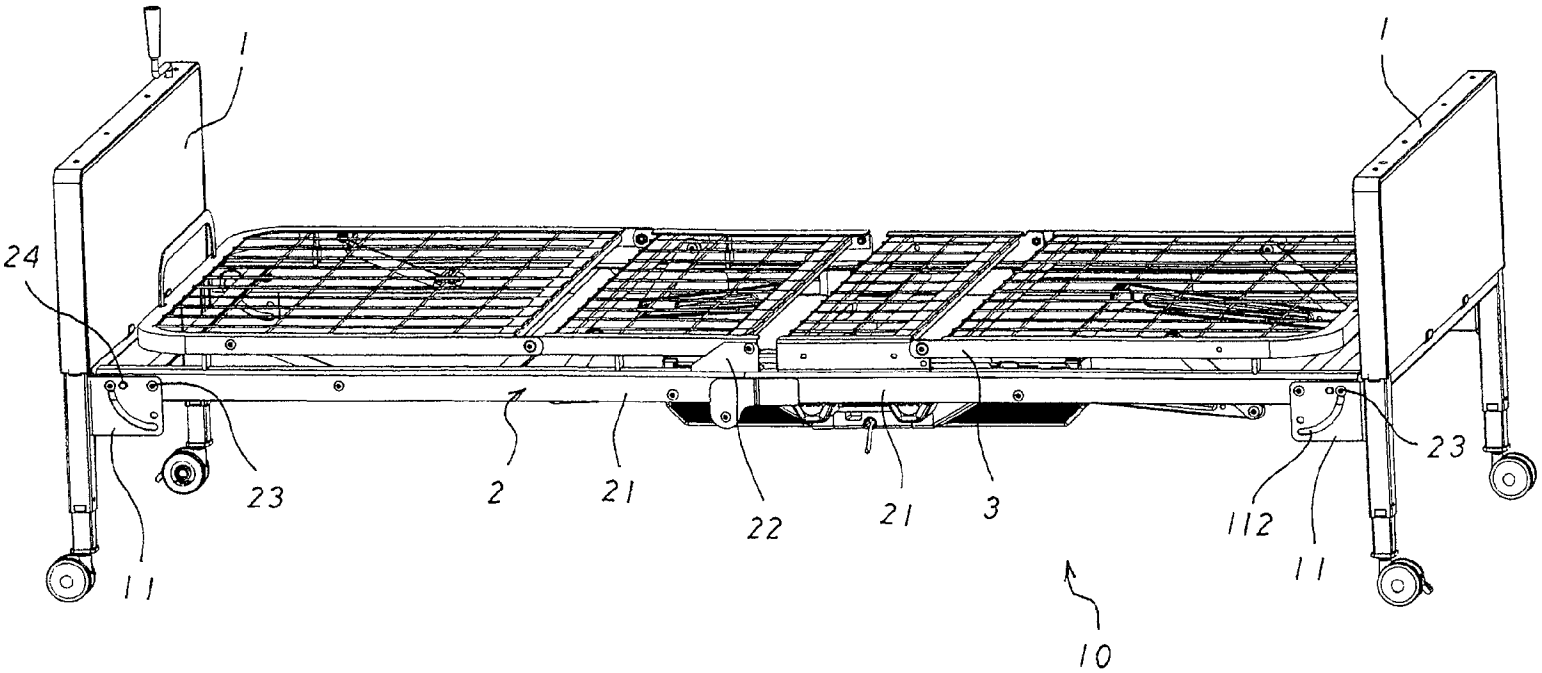
FIG. 1 is a perspective view showing the assembly of a foldable structure for a hospital bed according to a preferred embodiment of the present invention.
Figure 2:
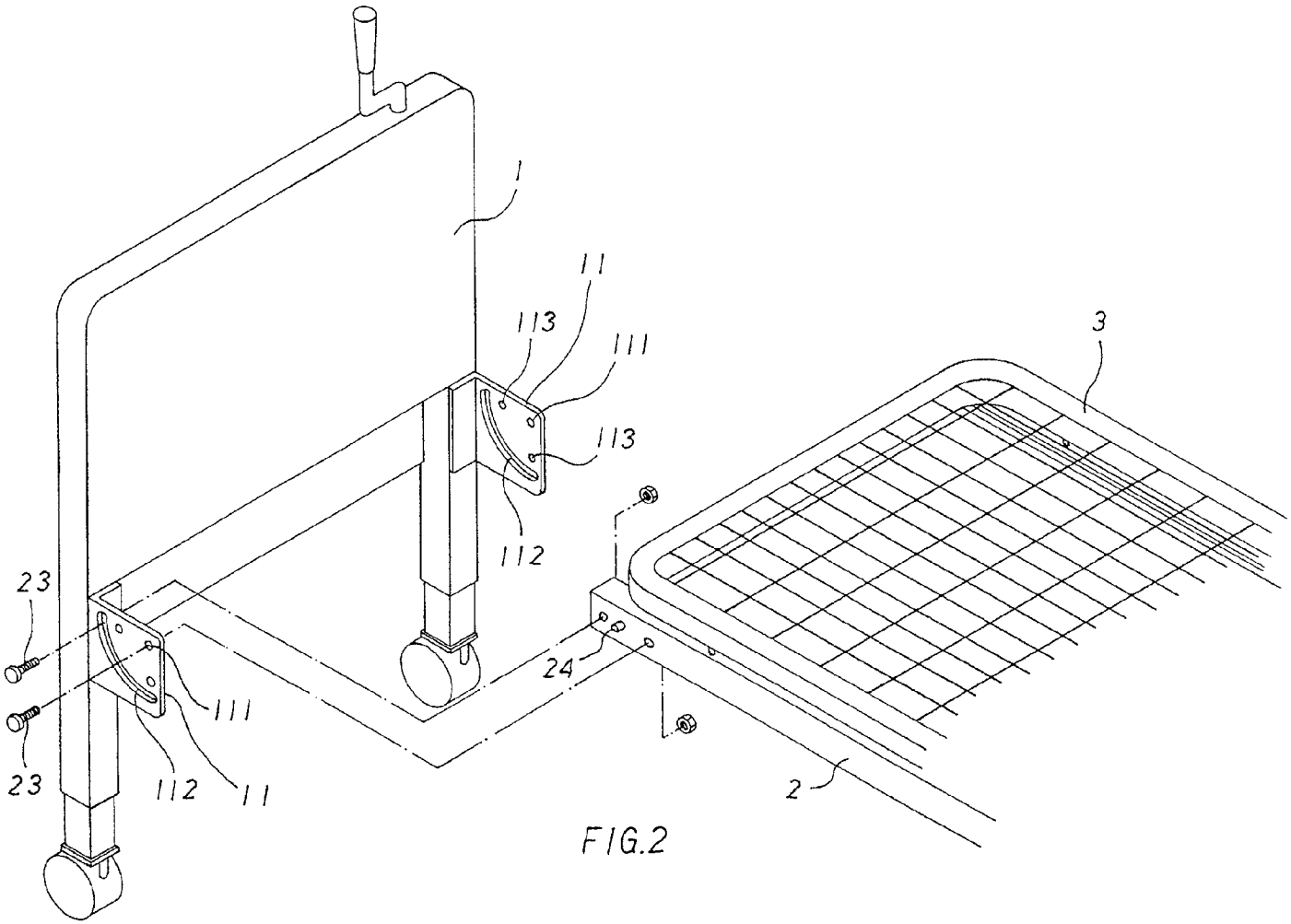
FIG. 2 is a perspective view showing the exploded components of a mount and a bed frame of the foldable structure for the hospital bed according to the preferred embodiment of the present invention.
Figure 3:
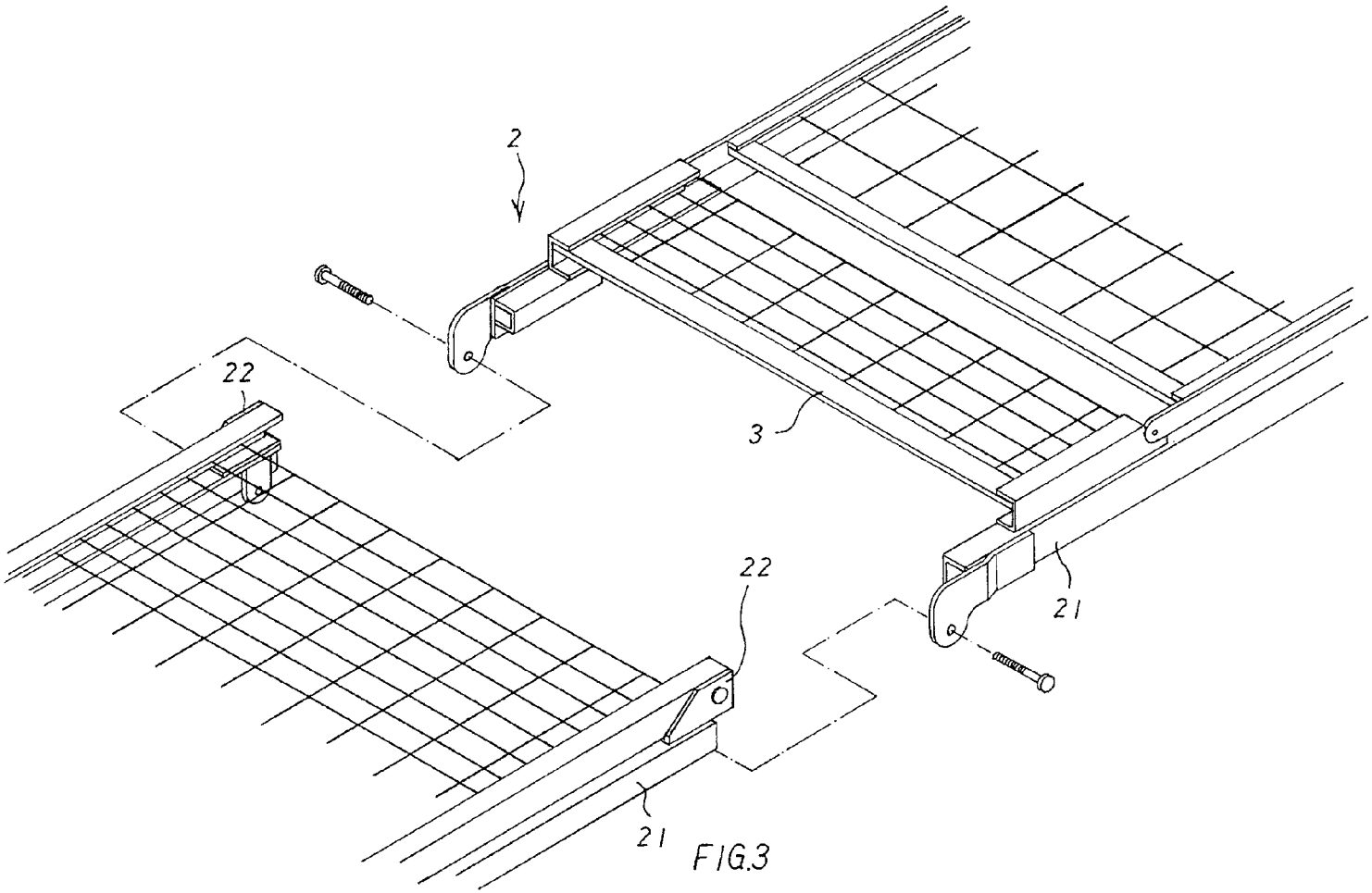
FIG. 3 is a perspective view showing the exploded components of the bed frame of the foldable structure for the hospital bed according to the preferred embodiment of the present invention.

A foldable structure for a hospital bed according to a preferred embodiment of the present invention comprises: two mounts 1 disposed on a front end and a rear end of a hospital bed 10, and each mount 1 including two rotary positioning pieces 11 fixed on two sides thereof and axially connecting with a bed frame 2 (as shown in FIGS. 1 and 2), the bed frame 2 including a plurality of rods 21 axially coupled on two sides of the bed frame 2 by aligning two contacting plates 22 with the plurality of rods 21 in an abutting manner (as illustrated in FIG. 3), and two middle rods 21 of the bed frame 2 are axially together so that the plurality of rods 21 on one side of the bed frame 2 fixed on the two contacting plates 22 and supported on the plurality of rods 21 on another side of the bed frame 2.

wherein each rotary positioning piece 11 has a hole 111 and an arcuate groove 112 defined under the hole 111 so as to axially connect the each rotary positioning piece 11 with two coupling elements 23 of the bed frame 2, such that the bed frame 2 rotates relative to the two mounts 1, and the each rotary positioning piece 11 also has two orifices 113 corresponding to two ends of the arcuate groove 112 so that a spring pin 24 of each side of the bed frame 2 is inserted into one of the two orifices 113 of the each rotary positioning pieces 11.

Figure 4:
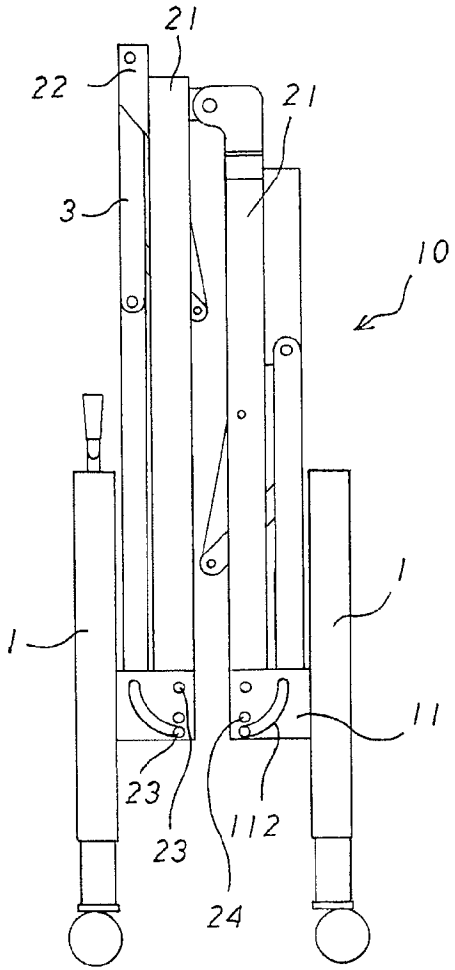
FIG. 4 is a plan view showing the operation of the foldable structure for the hospital bed according to the preferred embodiment of the present invention.

Thereby, a bed plane 3 of the hospital bed 10 is arranged on the bed frame 2 and has a plurality of sections so that the hospital bed 10 is operated at plural angles by using a hydraulic cylinder or motor (due to the bed plane 3 is a well-known art, further remarks are omitted here), such that the hospital bed 10 is retracted and expended by means of the two mounts 1 and the bed frame 2. Because the each rotary positioning piece 11 of the each mount 1 has the hole 111 and the arcuate groove 112 and axially couples with the two coupling elements 23 of the bed frame 2, when the bed frame 2 is retracted or expanded rotatably relative to the each mount 1, the spring pin 24 is pushed out of the one of the two orifices 113 of the each rotary positioning pieces 11, and a coupling element 23 in the arcuate groove 112 rotates smoothly relative to a coupling element 23 in the hole 111 so that the bed frame 2 is retracted or expanded rotatably relative to the each mount 1, and the spring pin 24 automatically inserts into the one of the two orifices 113, thus obtaining a positioning purpose (as shown in FIG. 4).

Figure 5:
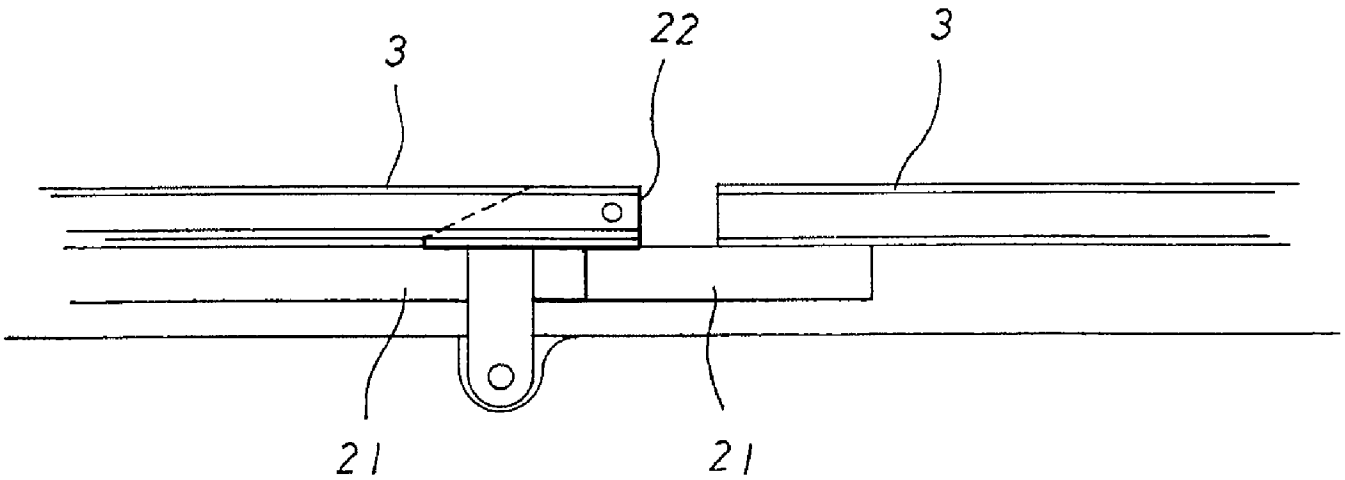
FIG. 5 is a plan view showing the operation of the bed frame of the foldable structure for the hospital bed according to the preferred embodiment of the present invention.

As retracting the bed frame 2, since the plurality of rods 21 are axially together and the plurality of rods 21 of the bed frame 2 are axially coupled on the two sides of the bed frame 2 by ways of the two contacting plates 22, the bed frame 2 is retracted upwardly so that the hospital bed 10 matches with the each mount 1 and the bed frame 2 to be stored in a flat shape and in a small size easily. When the hospital bed 10 is expended, the two contacting plates 22 on one of the plurality of rods 21 of one side of the bed frame 2 are fixed on another of the plurality of rods 21 of another side of the bed frame 2 (as illustrated in FIG. 5) so that a patient lies on the bed plane 3 of the hospital bed 10 securely, thus achieving a safety purpose and retracting and expanding the hospital bed 10 quickly.

While we have shown and described various embodiments in accordance with the present invention, it is clear to those skilled in the art that further embodiments may be made without departing from the scope of the present invention.

What is claimed is:

1. A foldable structure for a hospital bed comprising:

two mounts, a bed frame, and a bed plane arranged on the bed frame, each mount including two rotary positioning pieces fixed on two sides thereof and axially connecting and fixing with the bed frame, wherein each rotary positioning piece has a hole and an arcuate groove defined under the hole so as to axially connect the each rotary positioning piece with two coupling elements of the bed frame, such that the bed frame rotates relative to the two mounts, and the each rotary positioning piece also has two orifices corresponding to two ends of the arcuate groove so that a spring pin of each side of the bed frame is inserted into one of the two orifices of the each rotary positioning pieces, hence the spring pin is pushed out of the one of the two orifices of the each rotary positioning pieces, and a coupling element in the arcuate groove rotates smoothly relative to a coupling element in the hole so that the bed frame is retracted or expanded rotatably relative to the each mount.

2. The foldable structure for the hospital bed as claimed in claim 1, wherein the plurality of rods are axially together and the plurality of rods of the bed frame are axially coupled on the two sides of the bed frame by ways of the two contacting plates, thus retracting and expanding the bed frame.

* * * * *